US009702651B2

(12) United States Patent
Petersen

(10) Patent No.: US 9,702,651 B2
(45) Date of Patent: Jul. 11, 2017

(54) FIREARM SUPPRESSOR INSERT RETAINED BY ENCAPSULATING PARENT MATERIAL

(71) Applicant: DELTA P DESIGN, INC., Walterville, OR (US)

(72) Inventor: Byron Petersen, Springfield, OR (US)

(73) Assignee: Delta P Design, Inc., Walterville, OR (US)

( * ) Notice: Subject to any disclaimer, the term of this patent is extended or adjusted under 35 U.S.C. 154(b) by 0 days.

(21) Appl. No.: 14/838,869

(22) Filed: Aug. 28, 2015

(65) Prior Publication Data

US 2016/0061551 A1 Mar. 3, 2016

Related U.S. Application Data

(60) Provisional application No. 62/043,322, filed on Aug. 28, 2014.

(51) Int. Cl.
*F41A 21/30* (2006.01)
*F41A 21/28* (2006.01)

(52) U.S. Cl.
CPC ..... *F41A 21/30* (2013.01); *F41A 21/28* (2013.01)

(58) Field of Classification Search
CPC ..... F41A 21/30; F41A 21/28
USPC ..... 89/14.4; 181/223
See application file for complete search history.

(56) References Cited

U.S. PATENT DOCUMENTS 1,259,251 A * 3/1918 Love ..... F41A 21/30 181/223
3,385,164 A * 5/1968 Hubner ..... F41A 21/30 181/223
3,478,841 A * 11/1969 Hubner ..... F41A 21/30 181/223
4,291,610 A * 9/1981 Waiser ..... F41A 21/30 89/14.4
4,454,798 A * 6/1984 Shea ..... F41A 21/30 181/223
4,974,489 A 12/1990 Fishbaugh
5,029,512 A 7/1991 Latka
(Continued)

FOREIGN PATENT DOCUMENTS

WO 2014149142 A2 9/2014

OTHER PUBLICATIONS

Knowles, C., "Residual Stress Measurement and Structural Integrity Evaluation of SLM Ti-6A1-4V," Master of Science Thesis, University of Capetown, Department of Mechanical Engineering, Jul. 2012, 245 pages.

(Continued)

*Primary Examiner* — Joshua Freeman
(74) *Attorney, Agent, or Firm* — McCoy Russell LLP

(57) ABSTRACT

Methods and systems are provided for a sound suppressor adapted to be coupled to a firearm and including one or more inserts positioned within a body of the suppressor. In one embodiment, a sound suppressor comprises a unitary single-piece body, where an insert is positioned within the body and encapsulated by the body, the body and the insert forming one or more chambers, where the body and insert are bonded to one another via only interfacing surfaces of the body and insert. In this way, a more robust suppressor is constructed that is not vulnerable to the attrition that arises when using replaceable inserts bonded to the suppressor housing via welding.

16 Claims, 7 Drawing Sheets

(56) References Cited

U.S. PATENT DOCUMENTS

| | | | | |
|---|---|---|---|---|
| 6,079,311 | A * | 6/2000 | O'Quinn | F41A 21/30 42/79 |
| 6,374,718 | B1 | 4/2002 | Rescigno et al. | |
| 6,848,538 | B2 * | 2/2005 | Shafer | F41B 11/00 181/223 |
| 7,789,008 | B2 | 9/2010 | Petersen | |
| 7,874,238 | B2 | 1/2011 | Silvers | |
| 7,931,118 | B1 * | 4/2011 | Cronhelm | F41A 21/30 181/223 |
| 8,015,908 | B2 | 9/2011 | Kline et al. | |
| 8,087,338 | B1 | 1/2012 | Hines | |
| 8,091,462 | B2 | 1/2012 | Dueck et al. | |
| 8,096,222 | B2 | 1/2012 | Silvers | |
| 8,104,570 | B2 | 1/2012 | Miller et al. | |
| 8,167,084 | B1 * | 5/2012 | Moore | F41A 21/30 181/223 |
| 8,210,087 | B2 | 7/2012 | Latka | |
| 8,424,635 | B1 | 4/2013 | Klawunn | |
| D685,874 | S | 7/2013 | Andrews, Jr. et al. | |
| 8,479,632 | B2 | 7/2013 | Kline et al. | |
| 8,490,535 | B1 * | 7/2013 | Moore | F41A 21/30 181/223 |
| 8,505,431 | B2 | 8/2013 | Hines | |
| 8,511,425 | B2 | 8/2013 | Larue | |
| 8,522,662 | B2 * | 9/2013 | Presz, Jr. | F41A 13/08 181/223 |
| 8,567,556 | B2 | 10/2013 | Dueck et al. | |
| 8,578,719 | B2 | 11/2013 | Kirby | |
| 8,579,075 | B2 | 11/2013 | Brittingham et al. | |
| 8,739,922 | B2 * | 6/2014 | Wirth | F41A 21/30 181/223 |
| 8,807,272 | B2 | 8/2014 | Bladen | |
| D712,997 | S | 9/2014 | Proske | |
| 8,820,473 | B1 * | 9/2014 | White | F41A 21/34 181/223 |
| 8,910,745 | B2 | 12/2014 | Latka | |
| 8,973,481 | B2 | 3/2015 | Dueck et al. | |
| 8,991,551 | B2 | 3/2015 | Latka | |
| 8,991,552 | B2 | 3/2015 | Latka | |
| 9,102,010 | B2 | 8/2015 | Wilson | |
| 9,188,403 | B1 * | 11/2015 | White | F41A 21/30 |
| 2003/0145718 | A1 * | 8/2003 | Hausken | F41A 21/30 89/14.4 |
| 2010/0163336 | A1 * | 7/2010 | Presz, Jr. | F41A 13/08 181/223 |
| 2011/0107900 | A1 * | 5/2011 | Presz, Jr. | F41A 21/34 89/14.4 |
| 2012/0152649 | A1 | 6/2012 | Larue | |
| 2013/0180796 | A1 | 7/2013 | Dueck et al. | |
| 2013/0312592 | A1 | 11/2013 | Storrs et al. | |
| 2014/0262605 | A1 * | 9/2014 | Washburn, III | F41A 21/30 181/223 |
| 2015/0338183 | A1 * | 11/2015 | Salvador | F41A 21/30 181/223 |

OTHER PUBLICATIONS

Grunewald, S., "North America Just Tested Its First Functional Metal 3D Printed Gun Silencer," 3DPrintBoard Website, Available Online at https://3dprint.com/56493/metal-3d-printed-gun-silencer/, Apr. 7, 2015, 5 pages.

* cited by examiner

FIREARM SUPPRESSOR INSERT RETAINED BY ENCAPSULATING PARENT MATERIAL

CROSS-REFERENCE TO RELATED APPLICATIONS

The present application claims priority to U.S. Provisional Patent Application No. 62/043,322 entitled "FIREARM SUPPRESSOR INSERT RETAINED BY ENCAPSULATING PARENT MATERIAL," filed on Aug. 28, 2014, the entire contents of which are hereby incorporated by reference for all purposes.

FIELD

Embodiments of the subject matter disclosed herein relate to firearm sound silencers and, in one example, to a sound suppressor.

BACKGROUND

Firearms suppressors (also referred to as silencers) are mechanical pressure reduction devices with a through hole to allow the passage of a projectile. The firearm suppressor lowers the energy of the projectile propellant gases as they are exhausted behind the projectile in order to reduce the energy signature(s) of the exhaust gases. The exhaust gases are primarily the byproduct of nitrocellulose combusting in the confined space of the cartridge case and firearm bore. Shorter barrels may also result in an increased percentage of propellant solids in the gas stream. The exhaust gases are often moving at supersonic speeds and the high energy of the gas and particulate often leads to erosion, impingement and deformation of the firearm suppressor. The areas of the suppressor nearest to the firearm exhaust (muzzle) and in line with the firearm bore are exposed to the highest energy levels and are most susceptible to erosion and impingement, limiting application and duty cycle of the suppressor.

Other attempts to address the problems associated with high energy erosion of the suppressor include constructing a suppressor with an inner sleeve and a plurality of inserts. One example approach is shown by U.S. Pat. No. 8,087,338 in U.S. by Hines et al. Therein, the firearm suppressor comprises an internal insert sleeve member with a plurality of inserts and chambers disposed at locations along the insert sleeve. The inserts are removable from the insert sleeve and can be replaced and welded therein. However, the inventors herein have recognized potential issues with such system. As one example, the welded inserts are vulnerable to attrition caused by the high energy gases at the area nearest the firearm muzzle when projectiles are fired while using the suppressor. Therefore, a more robust construction of suppressor housing coupled to the inserts may be necessary to extend the lifetime of the firearm suppressor.

BRIEF DESCRIPTION

In one embodiment, the issues described above may be addressed by a suppressor including an insert retained by encapsulating material, for example where the insert is added to the suppressor during additive manufacturing, or 3-D printing such that a portion of the suppressor housing is formed, then the 3-D printing process is paused so the pre-formed insert can be added to the partially formed housing, and then the 3-D printing process can continue to form the housing that, in one example, fully encapsulates the insert. The suppressor housing may be formed as an integral single unitary piece, at least in the material directly contacting and surrounding the insert.

In another embodiment, the suppressor may be operatively configured to be attached to a firearm. The suppressor may include a tubular housing body defining a longitudinal, or central, axis, wherein the flanges of one or more inserts are integrated and encased within the parent component material of the housing material. In this way, only a single insert may be used or a plurality of inserts may be used. Alternatively, it will be appreciated that the inserts may be flange free and held securely within the suppressor body by frictional forces. Further, the inserts and a housing body may form a series of unitary and securely encapsulated pieces serving as baffles. The inserts may be spaced along at constant or varied distances. In addition, the area interposed between two adjacent inserts bounded by the interior wall of the housing may define one or more expansion chambers, wherein components of propellant gases from a discharged projectile may expand, slow in motion and reduce in temperature and pressure.

The housing may further comprise a projectile entrance portion and a projectile exit portion disposed at a longitudinally rearward region and a longitudinally forward region, respectively. The rearward end of the suppressor may have an opening sufficiently large enough to permit passage of at least a portion of a firearm barrel, where the silencer may attach via connectable interactions, such as interlacing threads.

In another embodiment, the suppressor includes the housing body, a thread insert (or blast baffle insert) and one or more wear inserts in fluid communication with the muzzle. Inserts disclosed herein may have a generally annular shape, having a projectile entrance opening and exit opening and a smooth, flange-free circumference. The flange-free insert may fit securely into the housing body, held by frictional forces, fully surrounded and in face sharing contact with the entire insert on at least the circumferential face of the insert. Alternatively, inserts disclosed herein may have a generally annular shape, having a projectile entrance opening and exit opening and at least one flange spanning circumferentially about said insert. The flange may fit securely into a complementary groove in the housing body, fully surrounding and in face sharing contact with the entire flange on at least three side. Alternatively, the flange may be fully or partially encased in the parent material of the housing body. In one example, a thread insert and/or blast baffle are disposed at the end of the suppressor body closest to the muzzle of a firearm. One or more wear inserts may also be disposed at locations along the longitudinal axis of the housing.

Other elements of the disclosed designs are shown in detail herein.

In this way, a firearm suppressor may be able to withstand the corrosive effects of projective propellant gases, and therefore extends the lifetime and overall costs of owning firearm suppressors.

It should be understood that the summary above is provided to introduce in simplified form a selection of concepts that are further described in the detailed description. It is not meant to identify key or essential features of the subject matter. Furthermore, the disclosed subject matter is not limited to implementations that solve any disadvantages noted above or in any part of this disclosure.

Note that the drawings are approximately to scale, although other relative dimensions may be used. Further, the drawings may depict components directly touching one another and in contact with one another and/or adjacent to one another, although such positional relationships may be modified, if desired. Further, the drawings may show components spaced away from one another without intervening components there between, although such relationships again could be modified, if desired.

DETAILED DESCRIPTION

The following description relates to various embodiments of a sound suppressor (also known as a silencer), as well as methods of making and using the device. Potential advantages of one or more of the example approaches described herein relate to maintaining the length and weight of the overall firearm and/or suppressor, while still enabling rapid cycling, reduced wear, superior heat resistance, reduced overheating, and various others as explained herein.

Figure 1:
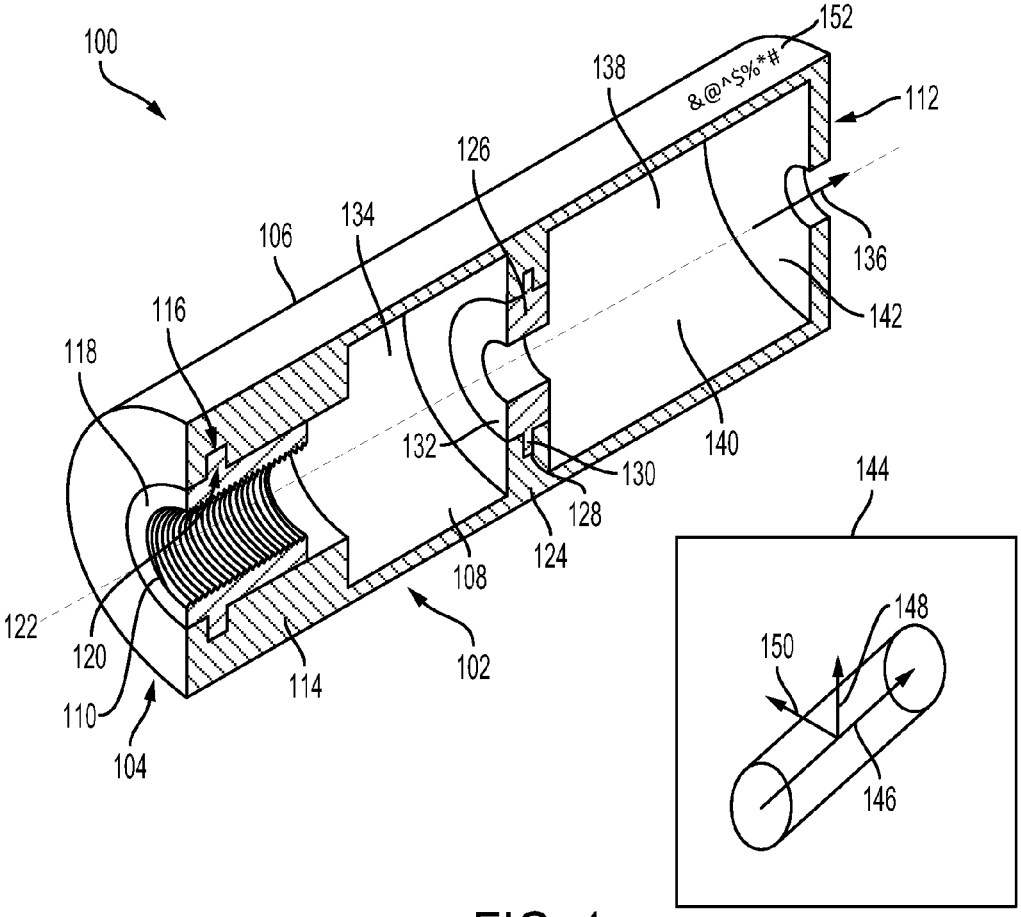
FIG. 1 is a cross-sectional view of an example suppressor assembly with an elongate tubular housing, wear insert and thread insert.

In accordance with the above and further objects of the invention, the present application discloses a firearm noise suppressor for reducing the sound from the expanding gases expelled from the muzzle region of a barrel. In one embodiment, the firearm noise suppressor may include an elongate tubular housing, wherein portions of one or more inserts are fully or partially encapsulated securely within one or more materials of the tubular housing spaced longitudinally along the interior of the housing, as shown in FIG. 1. A series of inserts may create turbulence of the gas, slowing its motion and reducing the temperature and pressure. The surface bounded by the inner housing surfaces contiguous with adjacent inserts may form a plurality of sufficiently large expansion chambers, wherein the propellant gases' motion may be hindered or slowed, and the pressure and/or temperature may be reduced.

Figure 2:
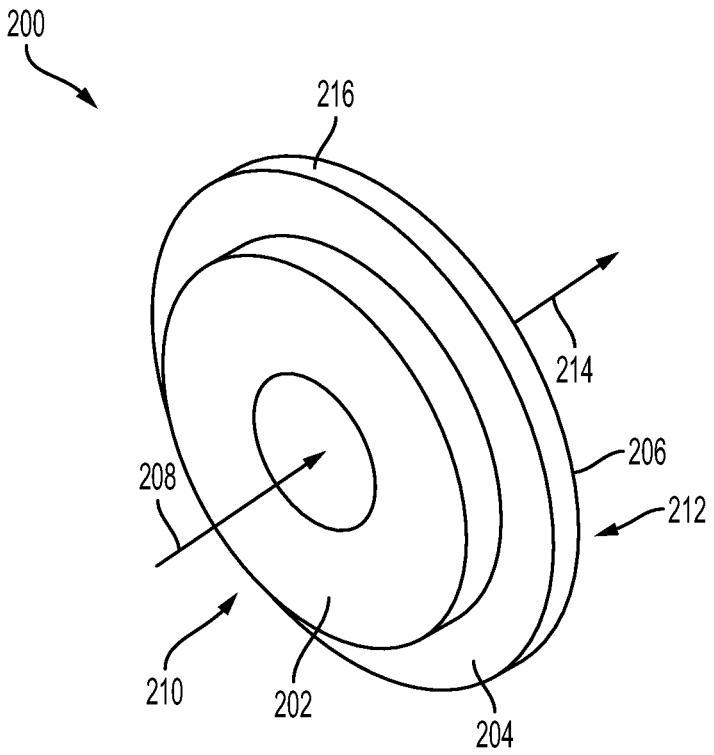
FIG. 2 is an enlarged perspective view of a wear insert.
Figure 3:
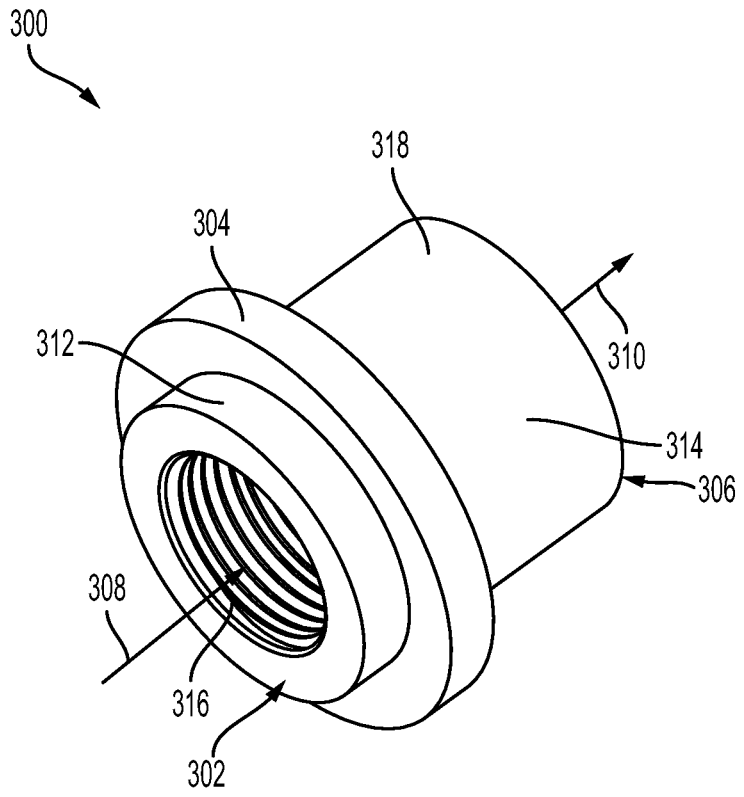
FIG. 3 is an enlarged perspective view of a thread insert.
Figure 5:
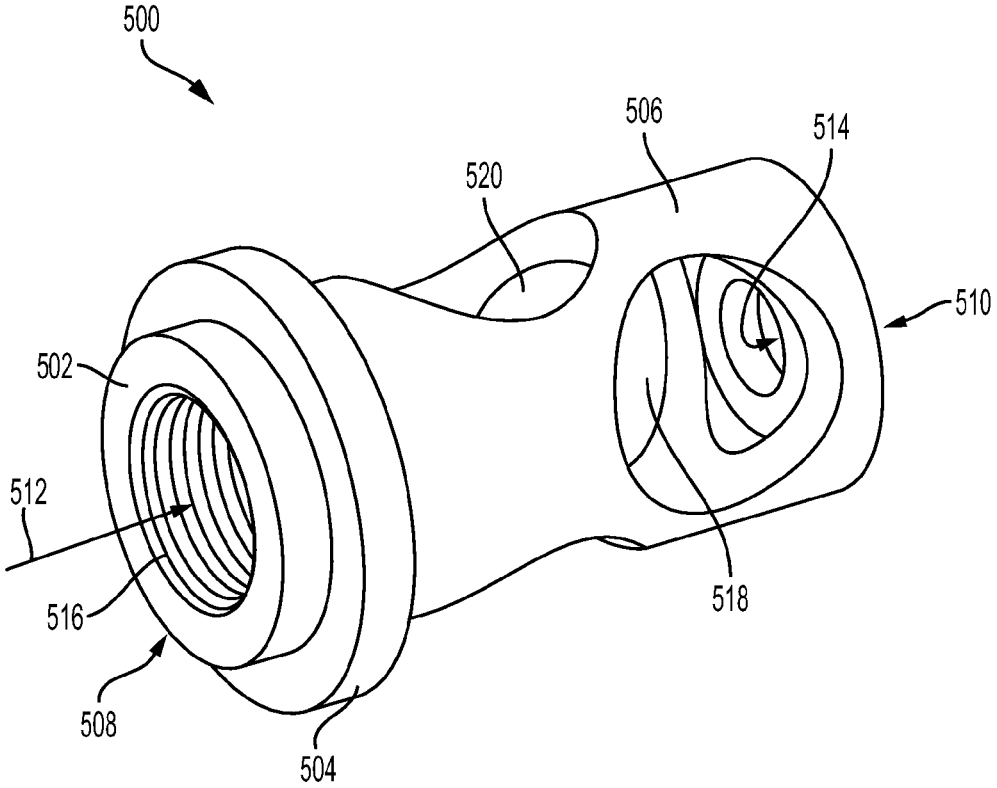
FIG. 5 is an enlarged perspective view of a blast baffle.

Inserts, as shown in FIGS. 2, 3, and 5, described herein, may perform several functions at once, such as mounting, wear reduction, and optimized geometry. In addition, the insert may contain geometry allowing it to interface with the encapsulating parent component of the housing and mechanically transmit force to the parent component through a mechanism other than the simple adhesion between the insert and the parent component. This insert geometry could include threads, ribs, lugs, etc. Alternatively, the inserts may interface with the encapsulating parent component of the housing in the absence of additional geometry other than the interfacing surfaces of the inserts, instead using frictional forces to mechanically transmit force to the parent component in the absence of adhesion between the insert and the parent component.

Figure 4:
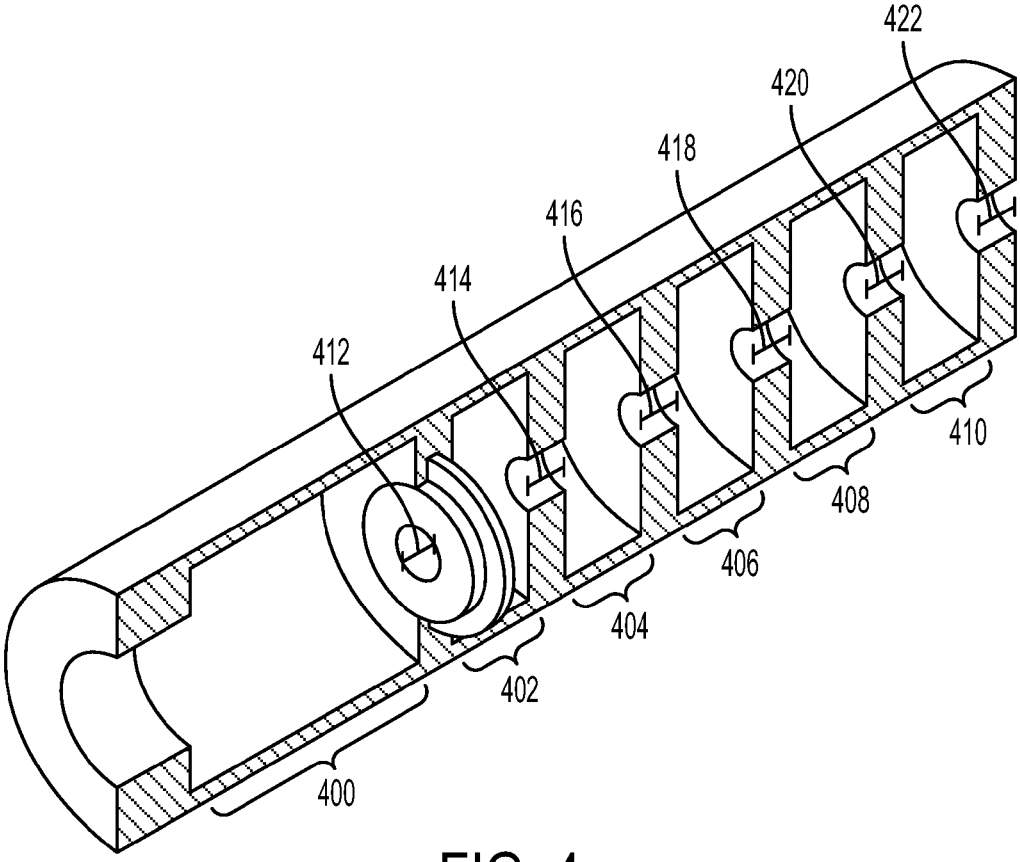
FIG. 4 is a cross-sectional view of another example suppressor assembly with an elongate tubular housing and wear insert.
Figure 6:
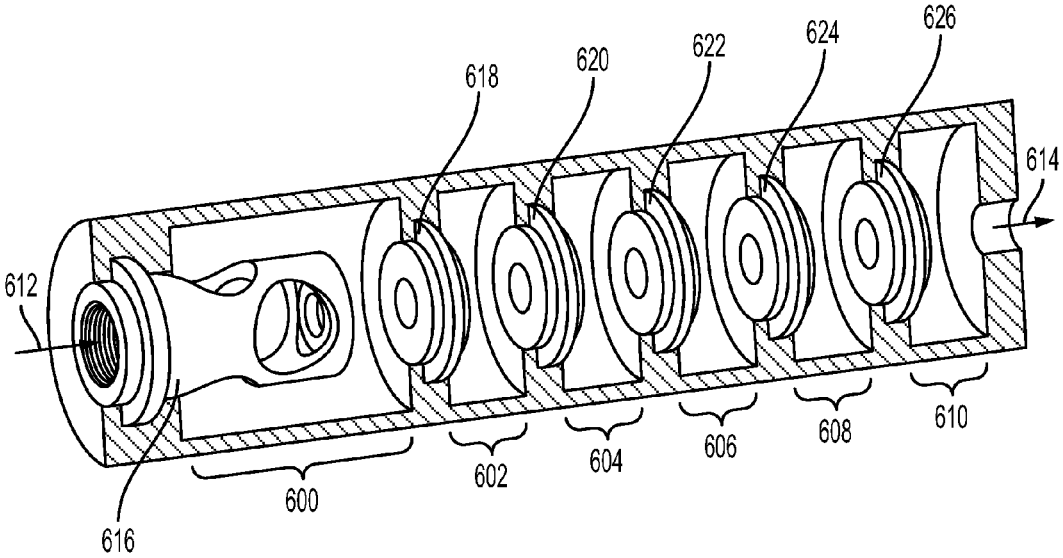
FIG. 6 is a cross-sectional view of an example suppressor assembly with an elongate tubular housing and a blast baffle.

Referring back to FIG. 1, as well as to FIGS. 4 and 6, in some embodiments, the suppressor includes at least a first expansion chamber comprising the bounded interior space of the housing body, a thread insert (or blast baffle) and one face of a first insert, in communication with the muzzle. The first expansion chamber is of sufficient size to diminish the energy of gases formed by discharge of the firearm to a temperature and pressure that may reduce erosion of structural components of the suppressor. The gas may then travel through one or more channels formed by an insert to a second chamber fluidically in communication with the first chamber, comprising the bounded interior space of the housing between the first and second insert. In another embodiment, a third or more expansion chambers may be included in the construction of the suppressor.

In some embodiments, the suppressor may be made out of a plurality of materials, or by a plurality of conditions or treatments of the same material (e.g., coating, heat treatments, etc.). Materials used for components of the suppressor and inserts may exist in different combinations as determined by application. In one example, the suppressor body (i.e. the tubular housing) may be formed from plastics, high nickel heat resistant alloys, titanium, or aluminum. In some examples, specific areas of the firearms suppressor may require geometry that is difficult to manufacture as a single component. Some geometry may also require manufacturing processes or operations that are suboptimal to complete in a single part.

FIG. 1 shows a cross-sectional isometric view of a firearm sound suppressor 100 (herein referred to as sound suppressor or suppressor) comprising a tubular housing 102, generally having a longitudinal forward region 112 and a longitudinal rearward region 104. As shown in FIG. 1, an axes system 144 is comprised of three axes, longitudinal axis 146, vertical axis 148 and lateral axis 150, wherein vertical axis 148 and lateral axis 150 each point radially outwardly from the central longitudinal axis 146. An actual central axis 122 is depicted by a dashed line running the length of the sound suppressor 100, which corresponds with longitudinal axis 146. In other embodiments, the sound suppressor 100 comprises a combination of one or more of thread inserts 118, wear inserts 126, and/or in some instances, a blast baffle (not shown; see blast baffle 500 in FIG. 5 and blast baffle 616 in FIG. 6). Further, the interlocking encapsulation of a traverse flange 120 of thread insert 118 by projection 114 of the tubular housing 102, for example, forms a generally annular channel 110 at rearward region 104 wherethrough a projectile may enter, travel through a plurality of channels formed by openings of one or more adjacent inserts, and then exit the sound suppressor 100 via exit passage 136 at longitudinal forward region 112. In one example of utilizing the sound suppressor 100, longitudinally rearward region 104 is abutted towards a muzzle portion of a barrel.

In one example, the tubular housing 102 including an inner surface 108 and outer surface 106 may comprise a homogenous component material including, but not limited to, plastics, high nickel heat resistant alloys, titanium, or aluminum. In some embodiments, the housing may be manufactured via processes including, but are not limited to: 3D printing (e.g. selective laser melting (SLM) or direct metal laser sintering (DMLS), selective laser sintering (SLS), fused deposition modeling (FDM), stereolithography (SLA) and laminated object manufacturing (LOM)), casting, molding, additive manufacturing, or forging. In yet more examples, tubular housing 102 may be made by excavating out the homogenous parent material to form the housing lumen 140 to fit the plurality of inserts (thread insert 118 and/or wear insert 126) therein. Further, one form of manufacture can include drilling out or another means of removing material to form the insert mount locations. The outer surface 106 may include an exterior marking 152. The exterior marking 152 may include one or more of a logo and identifying text, where the identifying text may include one or more of a serial number, model number, manufacturer name, city and state, etc. The exterior marking 152 may be formed during the additive manufacturing process of the suppressor 100. The additive manufacturing process (i.e., 3D printing) builds the suppressor 100 from the ground up, and may skip layers during the process to create an exterior marking 152 that appears imprinted in the final suppressor product. Alternatively, the additive process may lay extra material onto the suppressor during manufacturing so that the exterior marking 152 appears raised atop the outer surface 106 of the final suppressor product. Further still, the exterior marking 152 may include multiple components, some of which appear raised, and some of which appear imprinted, on the outer surface 106 of the suppressor 100. In one embodiment, each suppressor may have a unique identifying number (e.g., serial number) and manufacturer information (e.g., name, city, state). Some regulating bodies may require this information to be displayed on each suppressor. Forming the exterior marking 152 on the outer surface 106 during the manufacturing process of the entire suppressor reduces the additional costs, times, and difficulty associated with adding the exterior marking via a different process after the suppressor has been manufactured (e.g., post-manufacturing). In one example the resulting structure of the suppressor may include a plurality of adjacent layers of material integrally formed with one another where extra layers and/or missing layers are positioned to, in combination, form the exterior marking, such as the logo.

In another example, the inner surface 108 of tubular housing 102 may comprise of one or more projections 114, 124 circumferentially protruding orthogonally and inwardly towards the central axis 122 of suppressor 100, forming a plurality of cross bar regions (not shown) along lateral axis 150. Projections 114, 124 may also have one or more indented and concentric grooves, such as groove 116 and groove 128, along the projection's inner surface, having a generally square or annular shape, if viewed in a cross-section perspective. In another embodiment, other geometric shapes may be used. Such concentric grooves are disposed in the projections coaxial to the central axis 122 of the housing body.

In one embodiment, the housing material at the indented and concentric groove of the projections may partially or fully encapsulate and securely house a complementarily shaped traverse flange (such as the traverse flange 120 of thread insert 118 and the traverse flange 130 of wear insert 126) along its entire circumference. In other examples, a blast baffle is used (such as the blast baffle 616 in FIG. 6). The interlocking feature of the traverse flange of the wear and/or thread insert and/or blast baffle connectable to the concentric groove of the housing body forms an immovable, unitary, uninterrupted and contiguous interface. In some examples, the encapsulation and formation of the insert may be performed during the manufacturing of the encapsulating component. The insert may also be retained in the housing by deformation of the housing material after manufacture of the housing. These processes may include, but are not limited to: casting, staking, forming, etc. In some embodiments, the inserts may be manufactured via processes including, but are not limited to: selective laser melting (SLM), direct metal laser sintering (DMLS), selective laser sintering (SLS), fused deposition modeling (FDM), stereolithography (SLA) and laminated object manufacturing (LOM). Thus, the secured interface between the housing and inserts is considerably permanent such that the propellant gases from projectile discharge may impart reduced vibrational or high pressure damage to the sound suppressor. In an alternate embodiment, the insert may be devoid of flanges and retained in the housing by frictional forces. In this embodiment, an inner circumferential face of the projections (e.g., projection 114 or 124) may interface via face-sharing contact with an exterior circumferential face of an insert (such as threat insert 118 or wear insert 126). In this way, frictional forces between these mated surfaces may hold the inserts in place without any additional coupling element (e.g., such as welding, adhesive, or another type of fixture). Further, the manufacturing surfaces described above may create a bond between the face-sharing surfaces of the inserts and corresponding projections. In yet another embodiment, the insert(s) may be made within the suppressor as part of one continuous printing process, yielding a single unitary suppressor devoid of welding, fittings, threads, seams or any other adhesive properties between housing body and insert(s) other than the internal strength of the printed material itself (not shown). For example, when utilizing the DMLS printing process, the suppressor and inserts may be printed in one continuous process, so long as they are made of the same material, such as Inconel (an alloy of nickel containing chromium and iron, resistant to corrosion at high temperatures). In this embodiment the final product is a suppressor with inserts made of the same material as the housing body that is printed via DMLS, to form a single unitary body. As such, the housing body and the insert(s) of the suppressor are integrated with one another as one continuous part.

In another embodiment, projection 114 extends inward along lateral axis 150 for less than the lateral radius of tubular housing 102, and may span various widths along housing's longitudinal axis 126. In other embodiments, projections 114 may extend substantially inward towards the central axis of housing 102 such that the projection extend more than the lateral radius. This may form only a small opening 136 to allow passage of the projectile that may travel therethrough. In this particular example, at longitudinal forward region 112, no wear or thread insert may be interlocked with the projections. Various combinations of parameters of distance including the length of the inward extension of the projection(s) and width(s) along the housing's longitudinal axis may be made.

In other examples, the width of the wear and thread inserts may be variable compared to the longitudinal width of the projections along longitudinal axis 146. For example, the inserts may be shorter or longer than the projections, and may be shorter or longer compared to one another. In other instances, the wear and thread inserts may be the same width as one another, or the same width as the projection.

FIG. 1 further shows the inner surfaces 108 of tubular housing 102, faces of projections 114 and 124, and a face 132 of wear insert 126 defining a first expansion chamber 134. Similarly, the inner surface 108 of tubular housing 102, face of projection 124, opposite face of wear insert 126 (opposite face 132, not visible in FIG. 1), and a face of forward portion 142 may define a second expansion chamber 138. In other embodiments, a plurality of expansion chambers (e.g. 2-10 chambers) may be formed as defined by the passage space between the inner surface of the housing, projections and/or inserts.

FIG. 2 shows an isometric and enlarged view of a wear insert (previously described as wear insert 126 in FIG. 1). In one embodiment, wear insert 200 is generally annular in shape and comprises annular flange portions 202 and 206 at the rearward and forward regions 210 and 212, respectively, In the same embodiment, there is a traverse flange portion 204 disposed in an orthogonal configuration relative to annular flange portions 202 and 206 found at the rearward and forward regions, 210 and 212, respectively. Traverse flange portion 204 is configured to fit partially or completely within the concentric groove of the housing's projections such that a secure, unitary and contiguous interlocked interface is achieved about the circumference of said flange. In another embodiment, the traverse flange portion 204 may be sufficiently flat at edge 216. In this way, for example, the traverse flange portion 204 may be complementary to a correspondingly flat sided groove of a tubular housing projection (such as groove 128 of projection 124 in FIG. 1). A cutaway view of such embodiment may resemble interlocking and substantially square teeth. In another embodiment, there may be an absence of flanges such that the wear insert circumferential face lays flush with either the groove-free projection or inner surface of the tubular housing. For example, the wear insert may not include flange portion 204 and an outer circumference of the wear insert 200 may be in-line with flange portions 202 and 206. As such, an outer circumferential edge face of the flange portions 202 and 206 may be in face-sharing contact with an interior, flat, edge of the projections (e.g., no grooves). As such, the complementary relatively flat (e.g., groove and flange-free) surfaces of the projections and the wear insert may mate with one another via friction forces without an additional mechanical coupling elements, adhesives, or welding between the two components. For example, the wear insert 200 and the inner surface of the corresponding projection of the tubular housing (e.g., inner surface of projection 114 shown in FIG. 1) may only be coupled to one another at the outer edge faces of the flange portions 202 and 206 and the inner face of the projection.

In yet another embodiment, the wear insert 200 comprises a projectile entrance opening 208 and a projectile exit opening 214, wherein a channel is formed therethrough and has a substantially annular shape, if desired. The plurality of wear inserts may be manufactured from plastic, aluminum, titanium, Inconel alloys, maraging and stainless steel, and other materials.

Turning now to FIG. 3, an isometric and enlarged view of a thread insert 300 is shown, wherein the thread insert is substantially annular in shape. In general, the thread insert has a longitudinally rearward region 302 and a longitudinally forward region 306. Similar to a wear insert, thread insert 300 may comprise an annular flange portion 312 and an extended flange portion 318 at rearward region 302 and forward region 306, respectively. In some examples, a traverse flange portion 304 may be provided disposed in an orthogonal configuration relative to annular flange portion 312 and extended flange portion 318. The parent component of the housing body via one or more grooves on the projections may fully or partially encapsulate one or more traverse flange portion(s) 304 to form a contiguous and uninterrupted interlocked joint by means comparable to those described in detail in FIGS. 1 and 2. Further still, geometries of the thread insert, including the widths of each flange portion, may be dissimilar, wherein the forward region 306 extended flange portion 318 may be substantially longer in width than the rearward region 302 annular flange portion 312. In other examples, the reverse configuration is made. In yet other examples, the rearward and forward flanges are of the same or similar widths. In some embodiments, the wear insert may be made from plastic, aluminum, titanium, Inconel, maraging steel, etc. In alternative embodiments, the thread insert 300 may be flange free and not include traverse flange portion 304. As such, the circumferential outer faces of the annular flange portion 312 and extended flange portion 318 may be continuous with one another and lay flush with a groove-free projection or inner surface of the tubular housing (such as projection 114 if it were groove-free, and inner surface 108 of tubular housing 102, seen in FIG. 1). In this way, the outer face of the annular flange portion 312 and extended flange portion 318 may be in face-sharing contact with an inner face of a corresponding groove-free projection of the tubular housing. In this way, frictional forces between these mating faces may secure the thread insert 300 to the housing of the suppressor without any additional adhesives, welding, or mechanical coupling components.

In some embodiments the thread insert may contain specific geometry allowing the firearm to interface and engage with the suppressor, such as threads 316 or locking lugs. In one embodiment, a thread insert may be the first insert abutting the firearm muzzle. In addition, a longitudinally rearward region 302 of the thread insert as shown is adapted to have a projectile enter through the entrance opening 308 of the rearward annular flange portion 312 and exit through the exit opening 310 of the forward extended flange portion 318 via channel 314. Further still, geometries of the thread insert, including the widths of each flange portion, may be dissimilar, wherein the forward extended flange portion 318 may be substantially longer in width than the rearward annular flange portion 312. In other examples, the annular flange portion 312 and extended flange portion 318 are of the same or similar widths. In some embodiments, the thread insert may be made from plastic, aluminum, titanium, Inconel, maraging and stainless steel, etc.

FIG. 4 is a perspective view of an example suppressor assembly with a wear insert. As discussed with reference to FIG. 1, a plurality of expansion chambers (e.g. expansion chambers 400, 402, 404, 406, 408, and 410), and insert channels (e.g. insert channels 412, 414, 416, 418, 420, and 422) may be formed by integration of inserts into the housing projections via complementary grooves on the projections and flanges on the inserts and/or by the concentric housing projections themselves extending a selected distance towards a central longitudinal axis (such as longitudinal axis 146 in FIG. 1). Alternatively, similar integration of inserts may take place in the absence of insert flanges and housing projection grooves, whereby the inserts are held flush to the housing groove-free projection or housing inner surface via frictional forces. For example, a relatively flat inner face of the housing or projection may interface with a relatively flat outer face of the wear insert.

It can be appreciated that the wear inserts, as well as the thread inserts, may exist in various combinations and locations along the housing lumen (such as housing lumen 140, seen in FIG. 1). A plurality of channels is formed by the entrance openings and exit openings of the inserts arranged therein. A plurality of expansion chambers are of sufficient size(s) to diminish the energy of gases formed by discharge of the firearm to a temperature and pressure that may reduce erosion of structural components of the suppressor. Following discharge of a projectile, the emitted combustion gases may travel in a forward direction through one or more chambers formed by the boundaries of the inserts, projections and/or interior surface of the housing. The gas is transmitted through the chambers from rearward region towards the forward region of the housing, wherein each channel formed in an insert is in fluid communication with the adjacent chamber(s).

Turning now to FIG. 5, another example of a novel thread insert, herein referred to as a blast baffle, is shown in a perspective and enlarged view. Similar to a thread insert, a blast baffle 500 comprises a longitudinally rearward region 508 and a longitudinally forward region 510. Threads 516 at the rearward region 508 of blast baffle 500 may be configured to receive and engage with a threaded end portion of a firearm barrel such that the threaded connection between the blast baffle 500 and firearm end have interlocking threads. The blast baffle may be substantially annular in shape, having an annular flange portion 502 at rearward region 508 and an elongated body 506. Furthermore, the rearward region 508 of the blast baffle as shown is adapted to have a projectile enter through entrance opening 512 of the baffle's annular flange portion 502 and exit through elongated body 506 via exit opening 514. In some embodiments, the blast baffle 500 may replace the thread insert (such as thread insert 300 in FIG. 3) as the first insert abutting the firearm muzzle.

In some examples, a traverse flange portion 504 may be provided, which is positioned orthogonal to annular flange portion 502 and elongated body 506. In one embodiment, the groove of the projections of the tubular housing body (such as grooves 116 and 118 of projections 114 and 124, of tubular housing 102, as seen in FIG. 1) may fully or partially encapsulate about the circumference of the traverse flange to form a contiguous and immovable interface (as seen enveloping blast baffle 616 in FIG. 6). In another embodiment, elongated body 506 may have one or more gas discharge ports 520 disposed, for example as shown, as opposing pairs located along the circumference of the elongated body and parallel to the surface of the housing body. For example, a first set of ports may be located considerably closer to the forward region 510 on opposite sides of the elongated body, while a second set of ports may be located substantially closer to the traverse flange portion 504 near the rearward region 508 and disposed at sites diagonal to the first set of ports. In some embodiments, the ports may be sinusoidal or annular in shape. In other embodiments, the ports may have alternative geometries, including angular shapes such as squares. These ports provide a passage through which the high pressure propellant gas is dissipated laterally. After discharge of a projectile, the gas enters through entrance opening 512 and then may enter the chamber 518 of the elongated body and exit through one or more discharge ports 520 provided for possible swirling gas. Because the energy of propellant gases is highest at the muzzle, in some embodiments, the blast baffle may be made from high nickel heat resistant allow such as Inconel and/or carbide matrix material. These materials are highly heat resistant and may therefore be able to withstand the high energy of the propellant gases. It will be appreciated that as with the inserts in FIGS. 1-4, the blast baffle 500 may be held in place within the tubular housing via frictional forces alone, so that the outermost circumferential face of the baffle lay flush against a groove-free projection or inner surface of the housing body. In this embodiment, the baffle 500 may not include traverse flange portion 504.

Turning now to FIG. 6, an example of a suppressor assembly having a tubular housing, a plurality of wear inserts 618-626 and a blast baffle 616 is shown. As described in FIG. 4, the interior surfaces of the housing, and the faces of the wear inserts fixed in the housing projections form one or more chambers 600-610 in the lumen of the housing. By means of channels in the inserts, the chambers may be in fluid communication with the adjacent chamber(s). In this way, propellant gases entering through the blast baffle at entrance opening 612 may disperse and fill chambers 600 to 610, thus providing a turbulent like effect to reduce gas vibrational energy as the bullet projectile passes through the inner chamber regions. The reduced pressured gas continues until it exits through an exit opening 614 at a longitudinally forward region. It can be appreciated that various numbers of wear inserts, thread inserts and/or blast baffles (and corresponding interlocking projections or groove-free projections) may exist in different combinations and locations along the housing lumen (such as housing lumen 140 of FIG. 1), forming a plurality of expansion chambers. In some embodiments, the greater number of chambers may provide significant attenuation of propellant gas energy and structural stress.

It can be appreciated from the above descriptions that the inserts (wear, thread and blast baffle) and the housing body of the suppressor may be of the same materials, and additional heat treat properties and/or coating may be applied to one or more, or neither of the two components.

Figure 7:
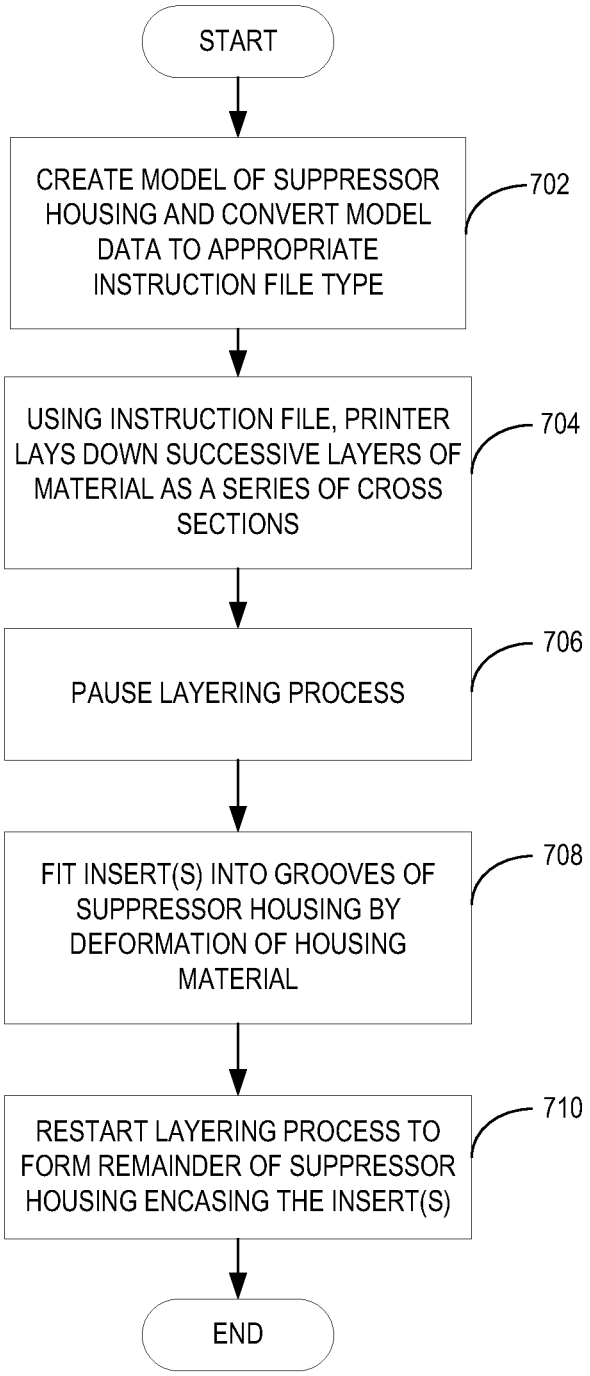
FIG. 7 is a flow chart of an example additive manufacturing process for constructing a firearm suppressor.

Lastly, FIG. 7 shows a flow chart of an example additive manufacturing method 700 to construct a suppressor as disclosed. In some embodiments, specific areas of the firearm sound suppressor may require geometry that is difficult to manufacture as a single component. As such, employing only conventional processes to construct a firearm suppressor as disclosed may be inadequate. Thus, novel processes and operations of manufacturing may be preferentially executed. In some embodiments, methods utilizing additive processes, such as in 3D printing, may be performed in order to form the described encasement of the flanges into the grooves of the housing body projections.

Method 700 begins at 702, where a model of a suppressor housing is created and then the model data is converted to the appropriate file type. In one example, a model of the suppressor housing having one or more projections may be drawn and converted into a corresponding CAD file readable by a 3D printer. At 704, using an instruction file, a printer lays down successive layers of material as a series of cross sections. For example, the 3D printer may then follow instructions defined by the CAD file to lay down successive layers of material, such as plastic and metals, to build a model from a series of cross sections. These layers, which correspond to the virtual cross sections from the CAD model, are joined or automatically fused during the additive process. In some embodiments, the process may be stopped at any point, such as in 706. At 706, the layering process is paused, prior to completion of the full suppressor housing construction. At 708, an insert or multiple inserts are fitted into grooves of the suppressor housing by deformation of housing material. Once all desired inserts are fitted within the groove(s), the 3D printer may be resumed. It will be appreciated that this method may include creating groove-free projections and flange free inserts, so that the outer circumferential face of the insert lay flush to an inner face of the projection or inner surface of the suppressor body. At 710, the layering process is restarted to form remainder of suppressor housing encasing the insert(s). Method 700 results in an encapsulated and unitary insert/housing component. The primary advantage of utilizing this method is that the contiguous and uninterrupted encasement of the insert by the housing allows the combined component to be substantially secured, durable, and immovable by the high energy gases of the discharged projectile. In an alternative embodiment the suppressor and inserts may be made of the same material (such as Inconel), and may be printed using direct metal laser sintering (DMLS), in which case a single unitary body, including the inserts, may be printed. In such an embodiment there may be no need to pause printing to fit inserts into grooves. Instead, the printing process would continue uninterrupted, laying down material in such a way that there is no division between housing body and insert.

The end product in this embodiment is a single unitary bodied suppressor made of a single material with no division (i.e., spaces between grooves/flanges) or additional adhesion (i.e., welding, bolts, threads, etc.) between housing and inserts, other than the internal strength of the material (such as Inconel) itself.

As such, additive processes appropriate and adequate for construction of the suppressor include, but are not limited to: selective laser melting (SLM) or direct metal laser sintering (DMLS), selective laser sintering (SLS), fused deposition modelling (FDM), stereolithography (SLA), and laminated object manufacturing (LOM).

From the above description, it can be understood that the energy suppressor and/or combination of the energy suppressor and firearm disclosed herein and the methods of making them have several advantages, such as: (1) they reduce the pressure (sound) of the report of the firearm with a minimal increase of the combined firearm and silencer length and weight; (2) they increase the life of the suppressor by reducing deterioration of the baffles from the exhaust components; (3) they improve accuracy and reduce the effect on vibration at the muzzle by way of reduced mass; (4) they aid in the dissipation of heat and reduce the tendency of the energy suppressor to overheat; and (5) they can be manufactured reliably and predictably with desirable characteristics in an economical manner.

Various advantages may be achieved, at least in some example implementations. For example, the structure described may provide inserts with heat resistant materials and/or with geometric designs that provide superior heat transfer, pressure reduction and vibration characteristics, while achieving both lightweight and high internal volume. Further, various features may enable the reduction of outlet pressure of discharge gases and resistance to structural stress.

It is further understood that the firearm sound suppressor described and illustrated herein represents only example embodiments. It is appreciated by those skilled in the art that various changes and additions can be made to such firearm sound suppressor without departing from the spirit and scope of this disclosure. For example, the firearm sound suppressor could be constructed from lightweight and durable materials not described. Moreover, the suppressor may further comprise of additional chambers not sequentially disposed along the longitudinal length of the housing, but rather along the lateral or radial axes of the housing. Also, although the firearm have been described herein to be fabricated as described in FIG. 7, another process or operation yielding a similar configuration of encapsulated inserts may be used.

In one example, a suppressor is provided having a unitary single-piece body forming one or more chambers, where an insert is positioned within the body and encapsulated by the body. The inserts may include one or more projections that extend outwardly and into material of the body. The body material may be positioned both forward and rearward of the projection along a central axis of the suppressor. Further, the body material may fully surround an exterior of the insert in a radial direction, but not block a front and/or rear face of the insert.

Further, a plurality of inserts may be positioned in the material of the body, each including said projections for locking the inserts into the body. However, the inserts may have different physical features, where a more upstream insert includes threads, and a more downstream insert does not include threads. Yet, each are encapsulated with the same interlocking structure. The body material and the insert material may be different, or the same. Further, different inserts may be made of different materials from each other As one embodiment, a sound suppressor comprises a unitary single-piece body, where an insert is positioned within the body and encapsulated by the body, and the body and the insert form one or more chambers, where the body and insert are bonded to one another via only interfacing surfaces of the body and insert.

As one example, the insert of said suppressor includes a first outer circumferential face and the suppressor body includes a first inner circumferential face, where the body and insert are bonded to one another only via the first outer circumferential face and the first inner circumferential face. The first inner circumferential face of the suppressor is positioned on a projection of the body, where the projection extends radially inward from the body toward a central axis of the suppressor. The first outer circumferential face of the suppressor is relatively flat and an outer diameter of the suppressor's first outer circumferential face and an outer diameter of the insert are relatively equal, wherein relatively equal means as close to equal as possible while still allowing the insert to fit within the housing body (i.e. outer circumferential face).

As another example, the insert includes one or more flanges that extend outwardly and into a material of the body, the material of the body positioned both forward and rearward of the one or more flanges along a central axis of the suppressor. For example, the material of the body fully surrounds an exterior of the insert in a radial direction without blocking a front and rear face of the insert, thus forming a bond between the first outer circumferential face of the insert and the first inner circumferential face of the body via encasing the insert within the body during a manufacturing process of the suppressor.

The embodiment may further include the first outer circumferential face of the insert and the first inner circumferential face of the suppressor body arranged in face-sharing contact with one another, wherein the insert and body are bonded to one another without any additional mechanical couplings, adhesives, or weldings. For example, the first outer circumferential face of the insert and the first inner circumferential face of the body may be bonded to one another via only frictional forces between the first outer circumferential face of the insert and the first inner circumferential face of the body.

Additionally, the sound suppressor may include an exterior marking on an outer surface of the body, where the exterior marking includes one or more of a logo and identifying text, which may include one or more of a serial number, model number, manufacturer name, city, and state. Wherein, the exterior marking may be formed on the outer surface during the additive manufacturing process of the suppressor.

Further still the suppressor may have one or more chambers that are spaced apart from one another along a longitudinal axis of the suppressor and formed by an inner surface of the body and axial faces of the insert. The inserts of the suppressor may include: a thread insert including internal threads configured to mate with a muzzle of a firearm, a wear insert including a relatively flat inner surface, and a blast baffle insert including internal threads configured to mate with the muzzle of the firearm and one or more gas discharge ports.

As another embodiment, a sound suppressor comprises an elongate tubular housing having an inner surface with one or more inner faces; and one or more inserts positioned within the housing and spaced longitudinally along an interior of the housing, where each of the one or more inserts includes an outer face in face-sharing contact with a corresponding inner face of the housing, where each of the one or more inserts and inner faces only mate with one another at the corresponding outer face and inner face without additional coupling elements.

For example, within the suppressor one or more inserts are formed within and encapsulated by the housing. Each inner face of the one or more inner faces of the inner surface of the housing is disposed on a corresponding projection of the housing extending radially inward from the inner surface and toward a central axis of the suppressor, where an inner diameter of the inner surface is greater than an inner diameter of the projection.

For example, the suppressor may have one or more inserts including a thread insert including an inner threaded surface and the outer face, where the outer face is in face-sharing contact with the inner face of the corresponding projection of the housing. The one or more inserts may include a blast baffle insert including a baffle inner surface where a portion of the baffle inner surfaces has threads and the outer face, where an upstream, first portion the outer face is in face-sharing contact with the inner face of the corresponding projection of the housing and a downstream, second portion of the outer face extends into a first expansion chamber formed by the inner surface of the housing and between the blast baffle insert and a downstream, second insert. Additionally, the one or more inserts may include a wear insert including an insert inner surface and the outer face, where the outer face is in face-sharing contact with the inner face of a corresponding projection of the housing and the insert inner surface forms an insert channel configured to pass a projectile from an upstream, first expansion chamber to a downstream, second expansion chamber.

As another embodiment, a firearm system comprises a firearm including a barrel with a muzzle portion and a suppressor coupled to the muzzle portion, where the suppressor includes a housing and one or more inserts spaced along a longitudinal central axis of the suppressor, where each insert of the one or more inserts is encapsulated by and secured within the housing by interfacing surfaces of the insert and the housing without additional coupling elements between the interfacing surfaces.

For example, the firearm system housing may include one or more projections having an inner face, and where each insert of the one or more inserts includes an outer face interfacing with the inner face of a corresponding projection of the one or more projections.

As another example, the firearm system may include one or more inserts include a blast baffle positioned at a rearward region of the suppressor, where the rearward region is proximate to the muzzle portion, and the blast baffle includes threads on an inner surface of the blast baffle that interface with interlocking threads on the muzzle. Furthermore, the blast baffle includes one or more gas discharge ports arranged in a body of the blast baffle that extends into an expansion chamber of the suppressor.

As another embodiment, a sound suppressor may comprise a housing body and an insert formed integral with and positioned within the housing body, where the housing body and the insert form one or more chambers, and the housing body and insert are comprised entirely of a same material and constructed via 3D printing to form a single unitary body. In one example, the material that both the housing body and insert are comprised entirely of is Inconel.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A sound suppressor, comprising:

a unitary single-piece body that includes a first projection at a longitudinally rearward region of the body and a second projection between the first projection and a longitudinally forward region of the body, where a chamber is formed between the first projection and the second projection, and where the first projection and the second projection each protrude circumferentially inward towards a central axis of the sound suppressor; and an insert, where the insert is positioned within the second projection of the body, a flange of the insert fit securely into a groove of the second projection so that the groove fully surrounds and is in face-sharing contact with the flange on at least three sides, where the insert is encapsulated by the body, the body and the insert forming chambers, and where the body and insert are bonded to one another via only interfacing surfaces of the body and insert.

2. The suppressor of claim 1, wherein the insert is a wear insert.

3. The suppressor of claim 2, where the first projection and the second projection extend radially inward from the body towards the central axis of the suppressor.

4. The suppressor of claim 2, wherein a blast baffle is held within the unitary single-piece body via the first projection.

5. The suppressor of claim 4, wherein the flange of the insert is a traverse flange that extends outwardly and into a material of the body, the material of the body positioned both forward and rearward of the traverse flange along the central axis of the suppressor.

6. The suppressor of claim 5, wherein the material of the body fully surrounds an exterior of the insert in a radial direction without blocking a front and a rear face of the insert.

7. The suppressor of claim 6, wherein the insert and the body are in face-sharing contact with one another and are bonded to one another without any additional mechanical couplings, adhesives, or weldings, wherein a bond is formed between the insert and the body via encasing the insert within the body during a manufacturing process of the suppressor.

8. The suppressor of claim 4, wherein the blast baffle and the body are bonded to one another via only frictional forces between the blast baffle and the first projection of the body.

9. The suppressor of claim 8, wherein the sound suppressor includes an exterior marking on an outer surface of the body, where the exterior marking includes one or more of a logo and identifying text, where the identifying text includes one or more of a serial number, model number, and manufacturer name, city, and state and wherein the exterior marking is formed on the outer surface during an additive manufacturing process of the suppressor.

10. The suppressor of claim 1, wherein a thread insert including internal threads configured to mate with a muzzle of a firearm is held within the body via the first projection.

11. A sound suppressor, comprising:

an elongate single-piece tubular housing having a plurality of projections, where the plurality of projections protrudes towards a central axis of the sound suppressor, each of the plurality of projections including a single groove between forward and rearward portions of each of the projections; and one or more inserts positioned within the housing and spaced longitudinally along an interior of the housing, where each of the one or more inserts includes an outer face in face-sharing contact with the groove of one of the plurality of projections of the housing, where each of the one or more inserts and projections only mate via face-sharing contact with one another.

12. The suppressor of claim 11, wherein the one or more inserts are formed within and encapsulated by the housing.

13. The suppressor of claim 12, wherein the plurality of projections is upstream an exit passage of the sound suppressor.

14. The suppressor of claim 13, wherein the one or more inserts includes a thread insert including an inner threaded surface and the outer face, where the outer face is in face-sharing contact with an inner face of a corresponding projection of the housing.

15. The suppressor of claim 13, wherein the one or more inserts includes a blast baffle insert including a baffle inner surface, where a portion of the baffle inner surface has threads and the outer face, where an upstream, first portion of the outer face is in face-sharing contact with an inner face of a corresponding projection of the housing and a downstream, second portion of the outer face extends into a first expansion chamber formed by the inner face of the corresponding projection and between the blast baffle insert and a downstream, second insert.

16. The suppressor of claim 13, wherein the one or more inserts includes a wear insert including an insert inner surface and the outer face, where the outer face is in face-sharing contact with an inner surface of a corresponding projection of the housing and the insert inner surface forms an insert channel configured to pass a projectile from an upstream, first expansion chamber to a downstream, second expansion chamber.

* * * * *